US010297900B2

(12) United States Patent
Lee et al.

(10) Patent No.: US 10,297,900 B2
(45) Date of Patent: May 21, 2019

(54) ELECTRONIC DEVICE WITH ANTENNA DEVICE

(71) Applicant: Samsung Electronics Co., Ltd, Gyeonggi-do (KR)

(72) Inventors: Young-Ju Lee, Seoul (KR); Seung-Tae Ko, Gyeonggi-do (KR); Hyun-Jin Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 50 days.

(21) Appl. No.: 15/401,022

(22) Filed: Jan. 7, 2017

(65) Prior Publication Data

US 2017/0201014 A1 Jul. 13, 2017

(30) Foreign Application Priority Data

Jan. 7, 2016 (KR) ..... 10-2016-0002003

(51) Int. Cl.

| | |
|---|---|
| ***H01Q 1/22*** | (2006.01) |
| ***H01Q 1/24*** | (2006.01) |
| ***H01Q 1/38*** | (2006.01) |
| ***H01Q 15/02*** | (2006.01) |
| ***H01Q 1/44*** | (2006.01) |

(Continued)

(52) U.S. Cl.

CPC ..... *H01Q 1/243* (2013.01); *H01Q 1/38* (2013.01); *H01Q 1/44* (2013.01); *H01Q 15/02* (2013.01); *H01Q 19/06* (2013.01); *H01Q 21/28* (2013.01); *H01Q 1/2291* (2013.01)

(58) Field of Classification Search

CPC ..... H01Q 1/243; H01Q 1/38; H01Q 15/02; H01Q 15/08; H01Q 1/2291

See application file for complete search history.

(56) References Cited

U.S. PATENT DOCUMENTS

| | | | | |
|---|---|---|---|---|
| 5,598,173 | A | 1/1997 | Lo Forti et al. | |
| 2004/0017331 | A1* | 1/2004 | Crawford | H01Q 3/44 343/909 |
| 2010/0066639 | A1 | 3/2010 | Ngyuen et al. | |

(Continued)

OTHER PUBLICATIONS

Foreign Communication from Related Counterpart Application, PCT Application No. PCT/KR2016/015073, International Search Report dated Mar. 21, 2017, 3 pages.

(Continued)

*Primary Examiner* — Dameon E Levi
*Assistant Examiner* — David E Lotter

(57) ABSTRACT

According to various embodiments of the present disclosure, an electronic device may include: an array antenna including a plurality of first radiating conductors that transmit or receive a wireless signal in a first frequency band and are arranged on a circuit board; and a lens unit including at least one lens disposed on a housing of the electronic device to correspond to the first radiating conductors. The lens unit may refract or reflect a wireless signal transmitted/received through each of the first radiating conductors. The electronic device as described above may be variously implemented according to embodiments. For example, a portion of the lens unit may transmit/receive a wireless signal in a frequency band that is different from the frequency band of the wireless signal transmitted/received by the first radiating conductors.

19 Claims, 18 Drawing Sheets

(51) Int. Cl.
*H01Q 19/06* (2006.01)
*H01Q 21/28* (2006.01)

(56) References Cited

U.S. PATENT DOCUMENTS

| | | | | |
|---|---|---|---|---|
| 2011/0128192 | A1* | 6/2011 | Lee | H01Q 1/243 343/702 |
| 2011/0199273 | A1 | 8/2011 | Kim et al. | |
| 2012/0013517 | A1 | 1/2012 | Lee et al. | |
| 2012/0044113 | A1 | 2/2012 | Satoh et al. | |
| 2012/0249388 | A1 | 10/2012 | Hansen et al. | |
| 2013/0249768 | A1 | 9/2013 | Anguera Pros et al. | |
| 2015/0091767 | A1 | 4/2015 | Matitsine et al. | |
| 2015/0116154 | A1 | 4/2015 | Artemenko et al. | |
| 2015/0116169 | A1 | 4/2015 | Ying | |

OTHER PUBLICATIONS

Foreign Communication from Related Counterpart Application, PCT Application No. PCT/KR2016/015073, Written Opinion of the International Searching Authority dated Mar. 21, 2017, 6 pages.

Communication from a foreign patent office in a counterpart foreign application, European Patent Office, "Supplementary European Search Report," Application No. EP 16884026.2, dated Oct. 18, 2018, 10 pages.

* cited by examiner

ELECTRONIC DEVICE WITH ANTENNA DEVICE

CROSS-REFERENCE TO RELATED APPLICATION(S) AND CLAIM OF PRIORITY

The present application is related to and claims the priority under 35 U.S.C. § 119(a) to Korean Application Serial No. 10-2016-0002003, which was filed in the Korean Intellectual Property Office on Jan. 7, 2016, the entire content of which is hereby incorporated by reference.

TECHNICAL FIELD

Various embodiments of the present disclosure relate to an electronic device. For example, various embodiments of the present disclosure relate to an electronic device including a mmWave antenna.

BACKGROUND

Wireless communication techniques have recently been implemented in various types (e.g., a wireless local area network communication (w-LAN) that are represented by the WiFi technique, Bluetooth, and near field communication (NFC)), in addition to a commercialized mobile communication network connection. Mobile communication services were initiated from a voice call service, and have gradually progressed to super-high-speed and large-capacity services (e.g., a high quality video streaming service), and it is expected that the next generation mobile communication service to be subsequently commercialized, including WiGig or the like, will be provided through an ultra-high frequency band of dozens of GHz or more.

As communication standards, such as NFC and Bluetooth, have become active, electronic devices (e.g., a mobile communication terminal) have been equipped with antenna devices that operate in various different frequency bands, respectively. For example, the fourth generation mobile communication service is operated in the frequency bands of, for example, 700 MHz, 1.8 GHz, and 2.1 GHz, WiFi is operated in the frequency bands of 2.4 GHz and 5 GHz although it may differ slightly depending on a rule, and Bluetooth is operated in the frequency band of 2.45 GHz.

In order to provide a service of stabilized quality in a commercialized wireless communication network, a high gain and a wide radiation area (beam coverage) of an antenna device should be satisfied. The next generation mobile communication service will be provided through an ultra-high frequency band of a dozen GHz or more (e.g., a frequency band that ranges from 30 GHz to 300 GHz and has a resonance frequency wavelength that ranges from 1 mm to 10 mm). A performance higher than that of an antenna device, which has been used in the previously commercialized mobile communication service, may be requested.

The resonance frequency wavelength of an antenna device, which is used in the band of dozens of GHz or more (hereinafter, referred to as a "mmWave communication band"), is merely in the range of 1 to 10 mm, and the size of a radiation conductor may be further reduced. There may be a lot of difficulty in securing a stabilized communication environment when a mmWave communication antenna is equipped in an electronic device. For example, due to the high straightness and directivity of the mmWave, a radiating performance of an antenna device may be considerably distorted depending on an installation environment. For example, when a manufactured mmWave communication antenna device is equipped in an electronic device or the like, the performance of the antenna device may be deteriorated due to an interference of a structure of the electronic device or the like.

Further, when antenna devices operating in a frequency band of an already commercialized wireless communication network are equipped in the electronic device, it may be difficult to secure a space for disposing the mmWave communication antenna.

SUMMARY

To address the above-discussed deficiencies, it is a primary object to provide an electronic device that is provided with an antenna device that is capable of providing a stabilized wireless communication function by preventing the distortion of a radiating performance according to an installation environment.

According to various embodiments of the present disclosure, it is possible to provide an electronic device that is provided with an antenna device that is capable of securing a stabilized radiating performance in the mmWave frequency band even though the antenna device is installed together with antenna devices that operate in a frequency band (hereinafter, referred to as a "commercially available frequency band" or a "commercially available communication network") of an already commercialized wireless communication network (e.g., a fourth generation mobile communication, WiFi, or Bluetooth).

According to various embodiments, there is provided an electronic device that may include: an array antenna including a plurality of first radiating conductors that transmit/receive a wireless signal in a first frequency band and are arranged on a circuit board; and a lens unit including at least one lens disposed on a housing of the electronic device to correspond to the first radiating conductors. The lens unit may refract or reflect a wireless signal transmitted/received through each of the first radiating conductors.

According to various embodiments, there is provided an electronic device that may include: a first antenna including a plurality of first radiating conductors that transmit/receive a wireless signal in a first frequency band and are arranged on a circuit board; and at least one second antenna that transmits/receives a wireless signal in a second frequency band that is lower than the first frequency band, and is arranged adjacent to the first radiating conductors. A portion of the second antenna may refract or reflect the wireless signal transmitted/received through each of the first radiating conductors.

The electronic device, which is provided with the above-described antenna device, is capable of securing a stabilized radiating performance by setting the array antenna and/or the first antenna as a mmWave communication antenna. For example, at least a portion of the lens unit and/or the second antenna is capable of compensating for the distortion of the radiating performance by a structure of the electronic device or the like by refracting or reflecting a wireless signal transmitted/received through the array antenna.

In addition, the second antenna is capable of stably transmitting/receiving a wireless signal in a frequency band of an already commercialized mobile communication network while compensating for the distortion of the radiating performance of the array antenna and/or the first antenna. For example, the electronic device including the antenna device according to various embodiments of the present disclosure is capable of performing stabilized wireless transmission/reception not only in an already commercialized mobile communication network, but also in a next generation mobile communication network.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
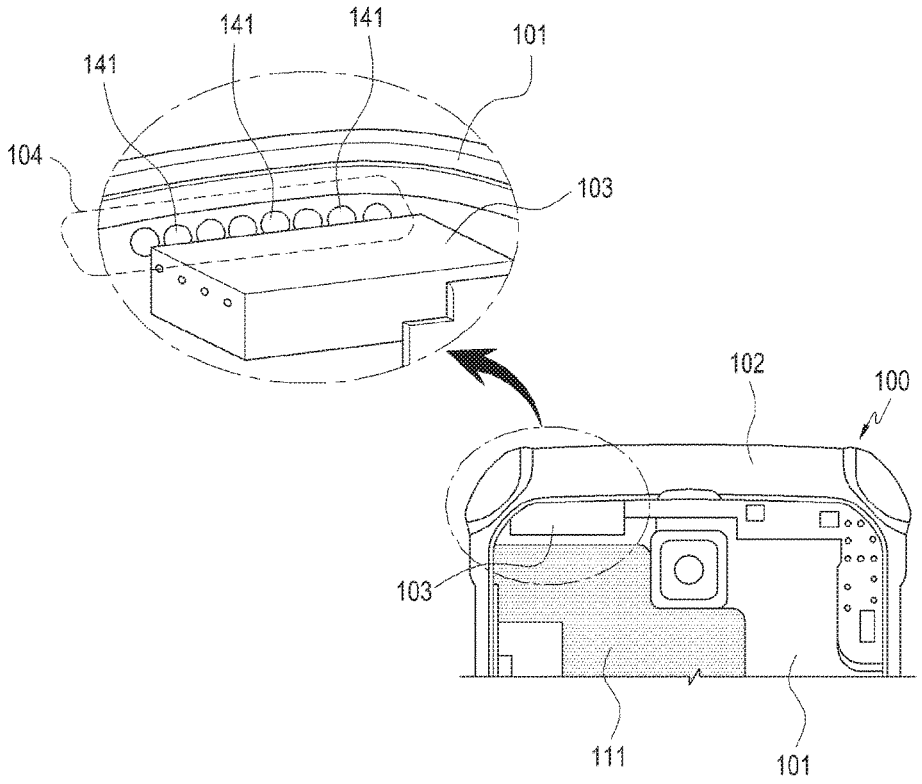
FIG. 1 illustrates a main portion of an electronic device according to one of various embodiments of the present disclosure.

FIGS. 1 through 27, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

In the various embodiments of the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

In the present disclosure, the terms are used to describe specific embodiments, and are not intended to limit the present disclosure. As used herein, the singular forms are intended to include the plural forms as well, unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification. In some cases, even the term defined in the present disclosure should not be interpreted to exclude embodiments of the present disclosure.

In the present disclosure, an electronic device may be a random device, and the electronic device may be called a terminal, a portable terminal, a mobile terminal, a communication terminal, a portable communication terminal, a portable mobile terminal, a display device or the like.

For example, the electronic device may be a smartphone, a portable phone, a game player, a TV, a display unit, a heads-up display unit for a vehicle, a notebook computer, a laptop computer, a tablet personal computer (PC), a personal media player (PMP), a personal digital assistants (PDA), and the like. The electronic device may be implemented as a portable communication terminal which has a wireless communication function and a pocket size. Further, the electronic device may be a flexible device or a flexible display device.

The electronic device may communicate with an external electronic device, such as a server or the like, or perform an operation through an interworking with the external electronic device. For example, the electronic device may transmit an image photographed by a camera and/or position information detected by a sensor unit to the server through a network. The network may be a mobile or cellular communication network, a local area network (LAN), a wireless local area network (WLAN), a wide area network (WAN), an Internet, a small area network (SAN) or the like, but is not limited thereto.

Figure 2:
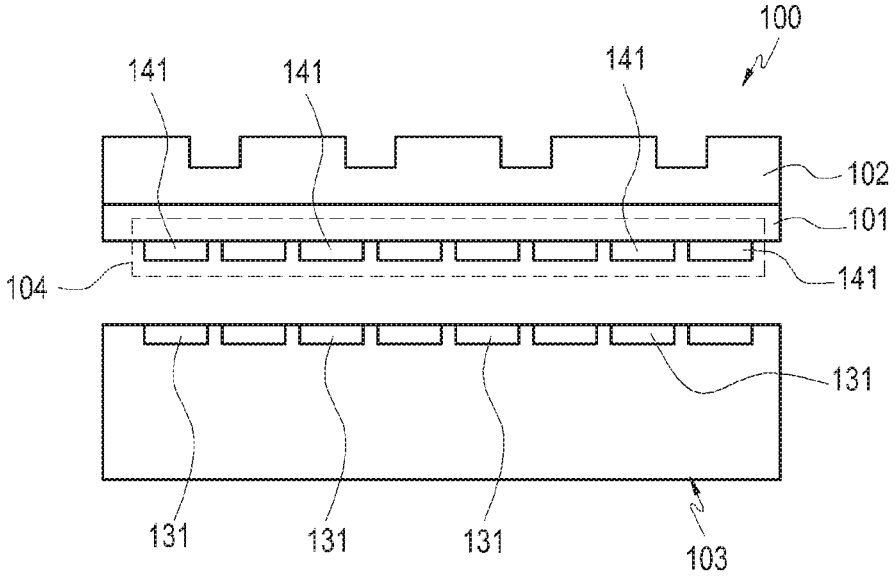
FIG. 2 illustrates a main configuration of the electronic device according to one of various embodiments of the present disclosure.

FIG. 1 illustrates a main portion of an electronic device 100 according to one of various embodiments of the present disclosure. FIG. 2 is a view for describing a main configuration of the electronic device 100 according to one of various embodiments of the present disclosure.

Referring to FIGS. 1 and 2, the electronic device 100 according to various embodiments of the present disclosure may include a first antenna 103 disposed within a housing 101 and a lens unit 104 disposed to correspond to the first antenna 103. Although not illustrated, the electronic device 100 may include various input/output devices installed on one face of the housing 101 (e.g., a display device, a camera module, a touch pad, and a sound module), and may control the input/output devices or store information input or output through the input/output devices by including a processor or a memory.

The housing 101 may provide a space for accommodating a structure on which various input/output devices or the like may be disposed and/or circuit devices, such as the processor, and may be at least partially made of an electrically conductive material. In using the electronic device 100 as described above, the user may use a protection cover 102 in order to relieve or prevent damage by an external environment, in which the protection cover 102 may be coupled at least partially enclose the housing 101.

The first antenna 103 may include one or more first radiating conductors 131. For example, the first antenna 103 may be an array antenna that includes a plurality of first radiating conductors 131 arranged on a circuit board. The circuit board on which the first radiating conductor(s) 131 is(are) disposed may be a main circuit board 111 accommodated in the housing 101, or another circuit board that is disposed separately from the main circuit board 111. Each of the first radiating conductors 131 may be formed as a combination of a via hole implemented in a circuit board, an electric conductor filled in the via hole, an electric conductor pattern implemented on the circuit board, and so on. Each of the first radiating conductors 131 is capable of transmitting/receiving a wireless signal by being fed with a power from a communication module (not illustrated) (and/or a communication circuit chip). According to various embodiments, the first radiating conductors 131 may configure an antenna that transmits/receives a wireless signal in a frequency band of dozens of GHz or more (e.g., a mmWave communication antenna). In the case in which the mmWave communication antenna (e.g., an array antenna) is formed using an array of the first radiating conductors 131, the first antenna 103 may include a communication circuit chip mounted on the circuit board (e.g., the circuit board on which the first radiating conductors 131 are arranged).

The mmWave communication antenna formed of first radiating conductors 131 and/or a combination of first radiating conductors 131 may include an antenna device disclosed in Korean Laid-Open Patent Publication No. 10-2015-0032972 filed in the name of the applicant of the present application and published on Apr. 1, 2015 (International Patent Publication No. WO2015/041422 published on Mar. 26, 2015). According to various embodiments, the first radiating conductor(s) 131 may be implemented in various forms (e.g., such as a Yagi-Uda antenna structure, a gridtype antenna structure, a patch type antenna structure, an inverted-F antenna structure, a monopole antenna structure, a slot antenna structure, a loop antenna structure, a horn antenna structure, and a dipole antenna structure) according to a combination of a via hole formed in a circuit board, an electric conductor filled in the via hole, a printed circuit pattern formed on the circuit board, and so on.

The lens unit 104 may be directly formed on an inner peripheral surface of the housing 101, or may be disposed as a separate structure. For example, the lens unit 104 may be directly formed on the inner face of the housing 101 in the process of manufacturing the housing 101, or may be assembled to the housing 101 together with the first antenna 103 after the housing 101 is separately manufactured. In the state where the housing 101 is formed and/or assembled, the lens unit 104 is capable of refracting and/or reflecting a wireless signal transmitted/received through the first antenna 103 and/or the first radiating conductor(s) 131. For example, when the first antenna 103 is disposed within the housing 101, the radiating characteristic of the first antenna 103 may be distorted by a structure of the housing 101 or the like. The distortion of the radiating characteristic as described above may be diversified according to the materials (e.g., an electric characteristic), shapes, or the like of the housing 101 and/or the protection cover 102.

In general, when a manufactured antenna device is mounted on a structure (e.g., the above-mentioned housing and/or a circuit board), the radiating performance of the antenna device may be deteriorated, compared to a designed radiating performance. This is because it is practically impossible to consider all the environments in which the antenna device is mounted (e.g., a shape of a structure) in the process of designing and manufacturing the antenna device.

The lens unit 104 may compensate for the distortion of the radiating characteristic according to the installation environment of the first antenna 103 by refracting and/or reflecting a wireless signal transmitted/received through the first antenna 103 and/or the first radiating conductor(s) 131. The lens unit 104 may include at least one lens 141 that is formed by a dielectric material, an electric conductor, and/or a combination of the dielectric material and the electric conductor. For example, FIGS. 1 and 2 exemplify a structure in which a plurality of first radiating conductors 131 and a plurality of lenses 141 are arranged to correspond to each other.

For example, by being manufactured in consideration of the material, shape, or the like of the housing 101, the lens unit 104 may develop an environment in which the first antenna 103 is capable of having a radiating performance close to the design specification even in the state where the lens unit 104 is mounted on the housing 101. Table 1 represents results obtained by measuring the gain of the first antenna 103 according to a design specification, the gain of the first antenna 103 in the state of being mounted on the first housing 101, and the gain of the first antenna 103 in the state of being mounted on the first housing 101 together with the lens unit 104.

Referring to Table 1, although there may be slide differences depending on the radiating direction, the design specification of the first antenna 103 is prepared such that the first antenna 103 can have a gain of about 16 dBi to 17 dBi. However, it can be seen that in the state where the first antenna 103 is mounted on the housing 101, the gain of the first antenna 103 is deteriorated to 9.4 dBi to 11 dBi. For example, the performance of the first antenna 103 may be distorted and/or deteriorated by the housing 101 and/or the protection cover 102. According to various embodiments of the present disclosure, it can be seen that when the lens unit 104 is mounted on the housing 101 together with the first antenna 103, the gain of the first antenna 103 is recovered to 15.5 dBi to 16.4 dBi. For example, it can be seen that by arranging the lens unit 104, the performance of the first antenna 103, which has been distorted and/or deteriorated by the housing 101 and/or the protection cover 102, is compensated to be close to the design specification.

TABLE 1

| Radiating Direction (angle; °) | Design Specification (dBi) | Mounting on Housing (dBi) | Arranging Lens Unit (dBi) |
|---|---|---|---|
| −30 | 16.24 | 9.6 | 15.97 |
| 0 | 16.95 | 9.4 | 15.51 |
| +30 | 16.08 | 11.01 | 16.41 |

Figure 3:
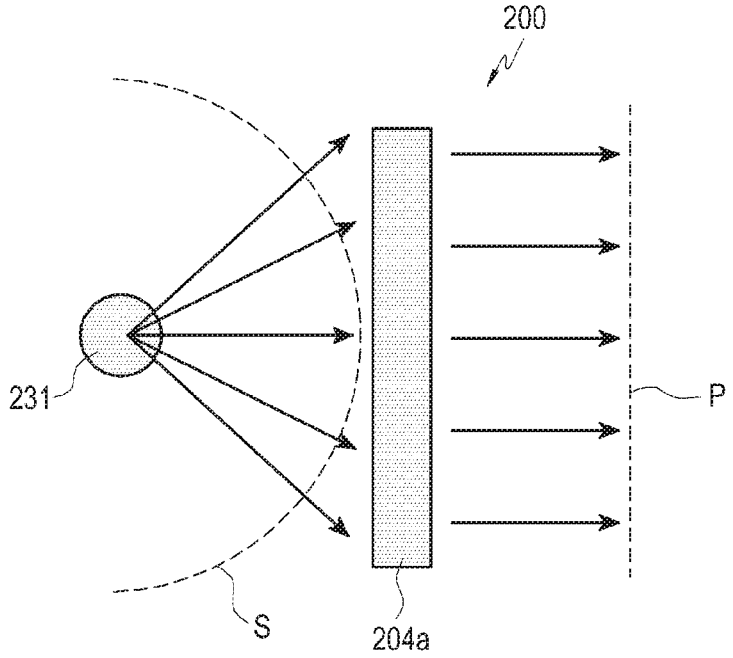
FIG. 3 illustrates an operation of an antenna device in an electronic device according to various embodiments of the present disclosure.
Figure 4:
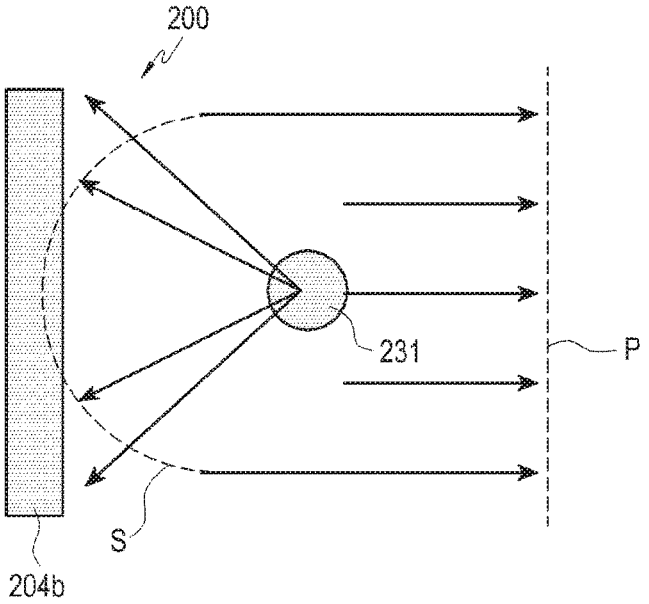
FIG. 4 illustrates a modification of the antenna device in the electronic device according to various embodiments of the present disclosure.

FIG. 3 illustrates an operation of an antenna device 200 in an electronic device according to various embodiments of the present disclosure. FIG. 4 is a view for describing a modification of the antenna device 200 in the electronic device according to various embodiments of the present disclosure.

Referring to FIGS. 3 and 4, in an electronic device according to various embodiments of the present disclosure (e.g., the electronic device 100 of FIG. 1), a wireless signal transmitted/received through radiating conductor(s) 231 (e.g., the first radiating conductor(s) 131) that forms(form) an array antenna may progress via lens units 204*a* and 204*b* (e.g., the lens unit 104 of FIG. 1 and/or FIG. 2). For example, the lens units 204*a* and 204*b* may reflect or refract the wireless signal transmitted/received through the radiating conductor 231. Referring to an example in which the wireless signal is transmitted from the radiating conductor 231, the wireless signals radiated from the radiating conductor 231 may have an equi-phase face that forms a circular (or spherical) shape S about the radiating conductor 231. When the wireless signals radiated from the radiating conductor 231 are refracted or reflected by the lens units 204*a* and 204*b*, the equi-phase face of the circular shape may be converted into a planar shape P. For example, by configuring the lens units 204*a* and 204*b* (e.g., the lens unit 104 in FIG. 1) in consideration of the shape of the housing 101 or the like, it is possible to adjust the radiation pattern (e.g., a phase, a radiating power, and/or a radiating direction) of a wireless signal radiated from the radiating conductor 231. The lens units 204*a* and 204*b* may include at least one lens that refracts or reflects a wireless signal. Various shapes of the lens units 204*a* and 204*b* will be described in more detail below.

Figure 5:
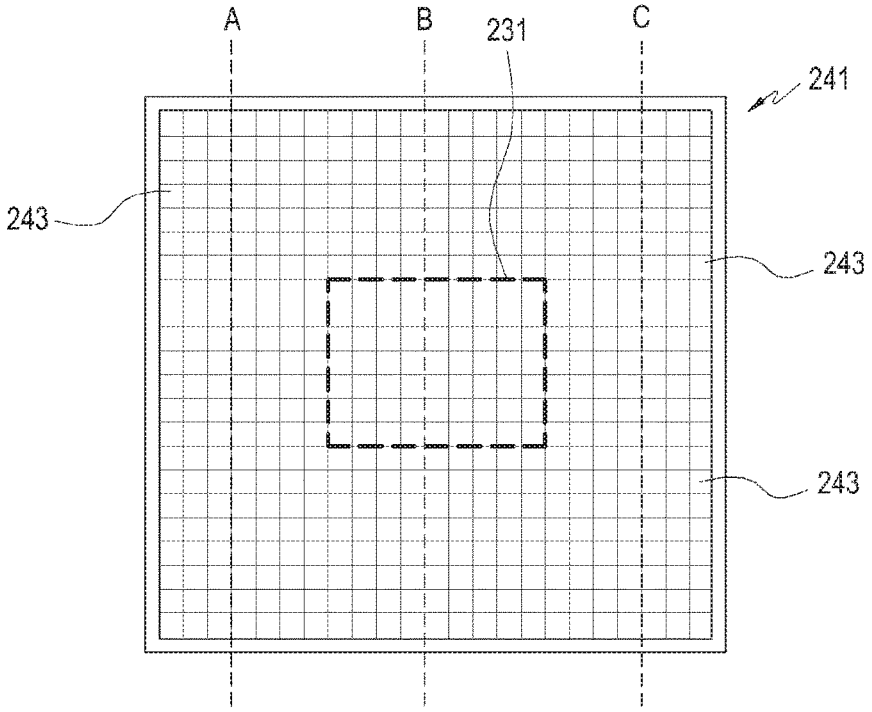
FIG. 5 illustrates an exemplary lens of the antenna device in the electronic device according to various embodiments of the present disclosure.

FIG. 5 illustrates an exemplary lens 241 of an antenna device in an electronic device according to various embodiments of the present disclosure. FIGS. 6A to 6C are views illustrating sectional shapes of the lens 241 illustrated in FIG. 5, which are obtained by cutting the lens 241 along lines A, B, and C in FIG. 5.

Figure 6:
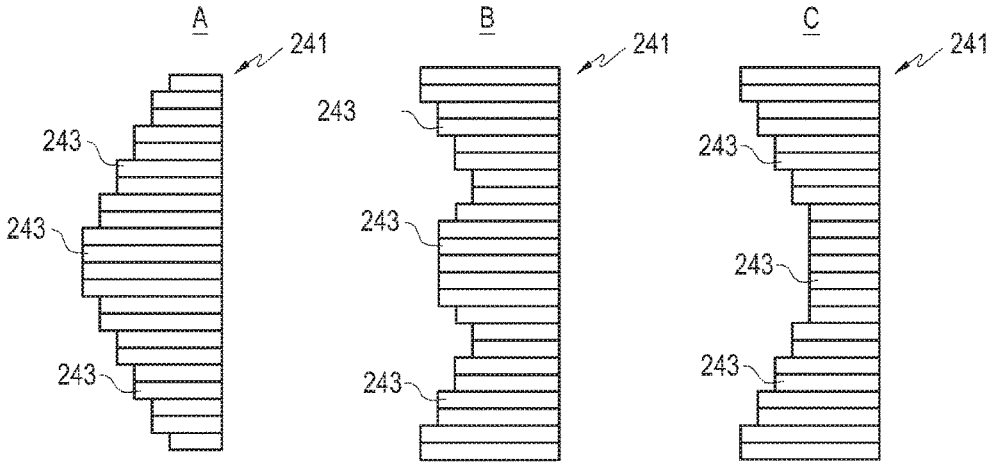
FIG. 6 illustrates a sectional shapes of the lens illustrated in FIG. 5, which are obtained by cutting the lens along lines A, B, and C in FIG. 5.

Referring to FIGS. 5 and 6, a plurality of lenses 241 (e.g., the lens 141 of FIG. 2) may be dielectric lenses disposed to correspond to the radiating conductors 231 (e.g., the first radiating conductors 131 of FIG. 2), respectively. The lens 241 may be a portion of the housing of the electronic device (e.g., the housing 101 of FIG. 1 and/or FIG. 2), or may be formed on the inner face of the housing 101. According to various embodiments, the lens 241 may be formed of a combination of unit cells 243, each of which is formed on the inner face of the housing of the electronic device (e.g., the housing 101 of FIG. 1 and/or FIG. 2). The unit cells 243 may have different shapes, sizes, or dielectric constants. For example, the shapes, sizes, or dielectric constants of the unit cells 243 may be different from each other according to a relative position in relation to the radiating conductor 231. In another embodiment, the shape, size, or dielectric constant of each of the unit cells 243 may be set or fabricated in consideration of a direction where it is intended to cause a wireless signal to progress. The shapes or arrangements of the unit cells 243 illustrated in FIG. 6 correspond to one of various embodiments of the present disclosure, and the present disclosure is not limited thereto. For example, as described above, the shapes and arrangements of the unit cells 243 may vary according to the relative positions in relation to the radiating conductor 231 and the direction in which it is intended to refract or reflect a wireless signal. As will be described below, some of the unit cells 243 forming the lens 241 may be formed of a dielectric material, and the others may be formed of an electric conductor.

Figure 7:
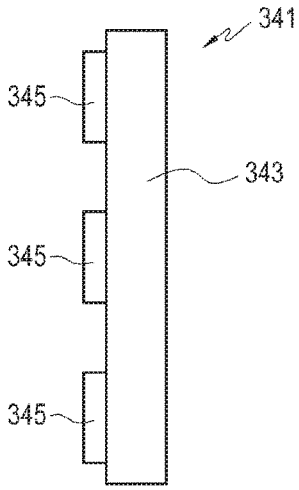
FIG. 7 illustrates another exemplary lens of an antenna device in an electronic device according to various embodiments of the present disclosure.
Figure 8:
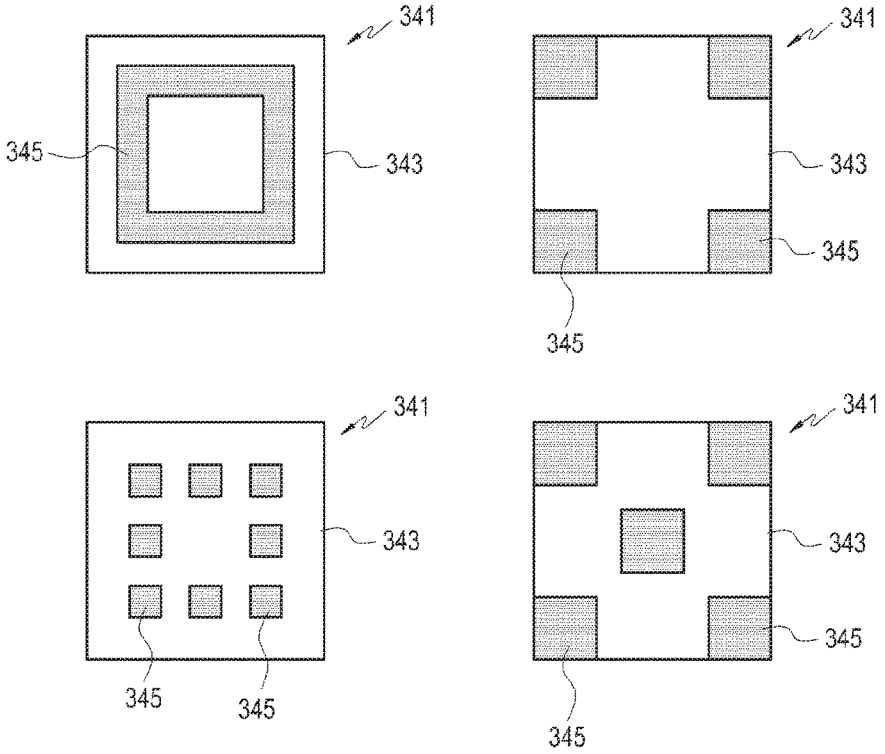
FIG. 8 illustrates various examples of the lens illustrated in FIG. 7.

FIG. 7 illustrates another exemplary lens 341 of the antenna device in the electronic device according to various embodiments of the present disclosure. FIG. 8 is a view for describing various examples of the lens 341 illustrated in FIG. 7.

Referring to FIGS. 7 to 8, the lens 341 may include a substrate 343 and conductor(s) 345 arranged on the substrate 343. The shapes or arrangements of the conductors 345 may vary according to the relative positions in relation to the radiating conductor (e.g., the radiating conductor 231 in FIG. 5), a direction where it is intended to refract or reflect a wireless signal, or the like.

According to various embodiments, the above-mentioned lens unit (e.g., the lens unit 104 of FIG. 2) may include a plurality of lenses (e.g., the lenses 141 of FIG. 2), and may include at least one of the dielectric lens 241 illustrated in FIG. 5 or the like and the conductor lens 341 illustrated in FIG. 7 or the like. For example, the above-mentioned lens unit (e.g., the lens unit 104 of FIG. 2) may be constituted with only dielectric lens(es), only conductor lens(es), or a combination of dielectric lens(es) or conductor lens(es).

Figure 9:
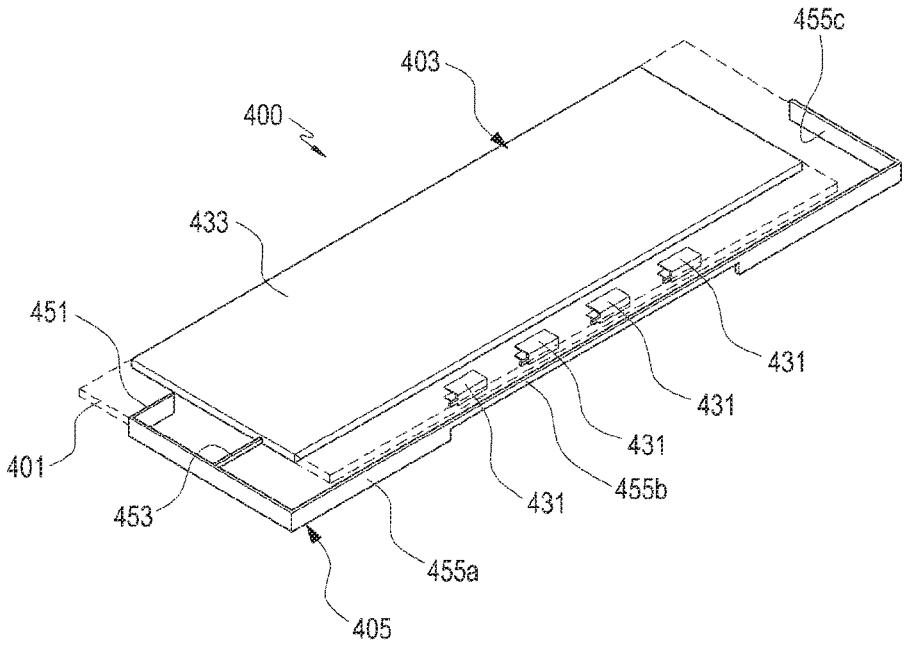
FIG. 9 illustrates one exemplary antenna device of the electronic device according to various embodiments of the present disclosure.

FIG. 9 illustrates one exemplary antenna device 400 of the electronic device according to various embodiments of the present disclosure.

Referring to FIG. 9, an antenna device 400 of an electronic device according to various embodiments of the present disclosure (e.g., the electronic device 100 of FIG. 1) may include a first antenna 403 (e.g., the first antenna 103 of FIG. 1 and/or FIG. 2) that transmits/receives a wireless signal in a first frequency band (e.g., the above-mentioned mmWave band) and at least one second antenna 405 that transmits/receives a wireless signal in a second frequency band (e.g., the above-mentioned frequency band(s) of commercially available communication network(s)) that is lower than the first frequency band. In one embodiment, the first antenna 403 may have an array antenna structure by including a plurality of first radiating conductors 431 arranged on a circuit board 433. In another embodiment, at least a portion of the second antenna 405 may be disposed adjacent to the first radiating conductors 431 so as to refract or reflect a wireless signal transmitted/received through each of the first radiating conductors 431. For example, a portion of the second antenna 405 may serve as a lens unit (e.g., the lens unit 104 of FIG. 2) that refracts or reflects a wireless signal.

Although not illustrated, the first antenna 403 may include a communication circuit chip that is mounted on the circuit board 433 to feed power to the first radiating conductor(s) 431. Because all the radiating conductor(s) 431 and the communication circuit chip are disposed on the circuit board 433, it is possible to suppress a feeding loss in feeding a power to the first radiating conductors 431 from the communication circuit chip. For example, the arrangement of the first radiating conductors 431 and/or the communication circuit chip as described above may suppress a feeding loss in a high frequency band as in mmWave communication.

In one embodiment, each of the first radiating conductors 431 may transmit/receive a wireless signal in the mmWave frequency band. Because a transmitted/received wireless signal having a higher frequency band may have higher straightness and directivity, the first antenna 403 may secure omni-directivity by arranging the plurality of first radiating conductors 431. The circuit board 433 may be manufactured separately from the main circuit board of the electronic device (e.g., the main circuit board 111 of FIG. 1), and may be mounted to be adjacent to the main circuit board and/or on one face of the main circuit board.

The second antenna 405 may include a second radiating conductors 455*a*, 455*b*, and 455*c* extending or disposed in a predetermined shape, and may transmit/receive a wireless signal of a second frequency band(s) that is(are) lower than that of the first antenna 403. The second radiating conductors 455*a*, 455*b*, and 455*c* may include a conductor disposed on the housing of the electronic device (e.g., the housing 101 of FIG. 1 and/or FIG. 2). In one embodiment, the second radiating conductors 455*a*, 455*b*, 455*c* may be formed by a portion of the housing. For example, the second radiating conductors 455*a*, 455*b*, and 455*c* may be disposed to correspond to a shape of a portion of the housing of the electronic device, or may form the portion of the housing. The second radiating conductors 455*a*, 455*b*, and 455*c* may include a first part 455*a* that is provided with a feeding terminal 453 and a ground terminal 451 at one end, a second part 455*b* extending from the other end of the first part 455*a*, and a third part 455*c* extending from the end of the second part 455*b*. Here, it is noted that the second radiating conductors 455*a*, 455*b*, and 455*c* are divided into a "first part," a "second part," and a "third part" merely for the convenience of description, and the present disclosure is not limited by the division. Each of the feeing terminal 453 and the ground terminal 451 may be connected to any one of the main circuit board 401 and the circuit board 433 so as to feed a power to the second radiating conductors 455*a*, 455*b*, and 455*c* or ground the second radiating conductors 455*a*, 455*b*, and 455*c*. The connection of the feeding terminal 453 and the ground terminal 451 will be described in more detail below. It can be seen that the first part 455*a* and the third part 455*c* have generally similar shapes, but the second part 455*b* has a shape that is somewhat different from those of the first and second parts 455*a* and 455*b*. The second part 455*b* may be positioned to substantially face the first radiating conductors 431, and may refract or reflect a wireless signal transmitted/received through the first radiating conductors 431. For example, in the present embodiment, the second part 455*b* may function as a lens and/or a lens unit for refracting a wireless signal (e.g., the lens 141 and/or the lens unit 104 in FIG. 2) while being a portion of the second radiating conductors 455*a*, 455*b*, and 455*c*.

Figure 10:
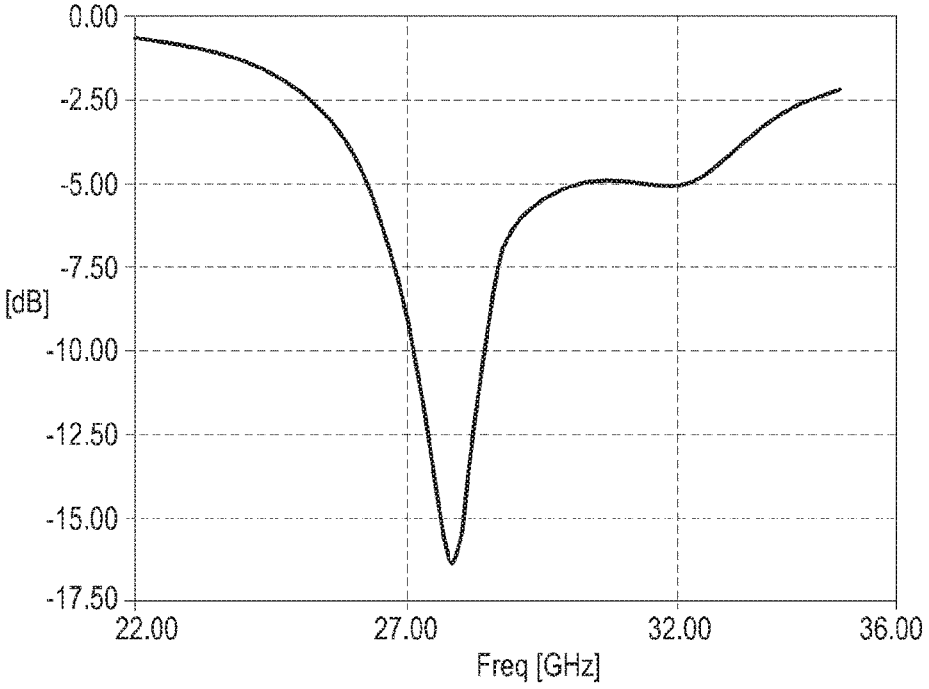
FIG. 10 illustrates a radiating characteristic of the antenna device according to various embodiments of the present disclosure.
Figure 11:
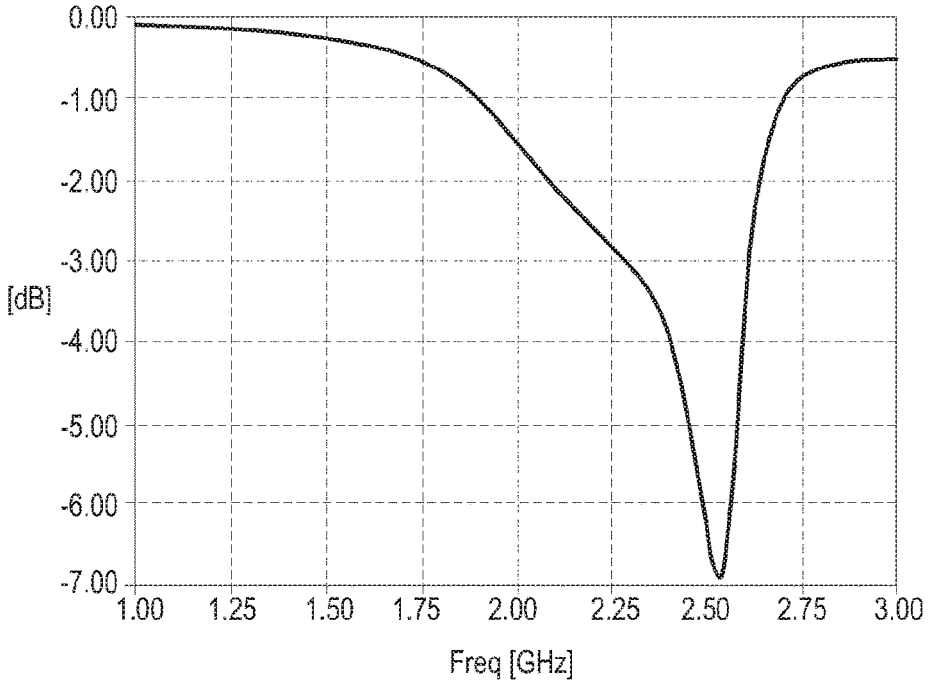
FIG. 11 illustrates another radiating characteristic of the antenna device according to various embodiments of the present disclosure.

Each of FIGS. 10 and 11 illustrates a radiating characteristic of the antenna device 400 illustrated in FIG. 9.

Each of FIGS. 10 and 11 represents reflection coefficients measured at the feeding stages of the first radiating conductor 431 and the second radiating conductors 455*a*, 455*b*, and 455*c*, in which, in a region (frequency band) where the reflection coefficient is low, each of the first radiating conductor 431 and the second radiating conductors 455*a*, 455*b*, and 455*c* may form a resonance frequency so as to transmit/receive a wireless signal. It is noted that the above-mentioned measurement result is merely to measure a change in radiating characteristic of each frequency band (e.g., an antenna gain or efficiency) according to the arrangement of the first radiating conductor 431 and the second radiating conductors 455*a*, 455*b*, and 455*c*, and the measurement result does not limit the present disclosure.

Referring to FIG. 10, it can be seen that in the state of being located adjacent to the second radiating conductor(s) 455*a*, 455*b*, and 455*c*, the first antenna 403 (e.g., the first radiating conductors 431) forms a resonance frequency in the mmWave frequency band (e.g., in an approximately 28 GHz band). In addition, as a result of measuring the maximum gain of the first antenna 403 in the radiating direction, although the maximum gain was measured as 5.56 dBi before the second radiating conductor(s) 455*a*, 455*b*, and 455*c* was(were) disposed, but was measured as 8.2 dBi after the second radiating conductor(s) 455*a*, 455*b*, and 455*c* was(were) disposed. For example, it has been found that by disposing the second radiating conductor(s) 455*a*, 455*b*, and 455*c*, the maximum gain of the first antenna 403 is improved by 2.5 dBi or more. In addition, it has been found that the front to back ratio of the first radiating conductor 431 is improved from 1.56 dBi to 3.6 dBi after the second radiating conductor(s) 455*a*, 455*b*, and 455*c* is(are) disposed. For example, it has been found that as the second part 455*b* of the second radiating conductors 455*a*, 455*b*, and 455*c* refracts a wireless signal transmitted/received through the first radiating conductors 431, the radiating characteristic of the first antenna 403 can be stabilized and improved.

Referring to FIG. 11, in the state where a portion (e.g., the second part 455*b*) of the second radiating conductor(s) 455*a*, 455*b*, and 455*c* is disposed adjacent to the first radiating conductor(s) 431, the second antenna 405 formed a resonance frequency in an approximately 2.5 GHz band, and the radiating efficiency was measured as about 89%. For example, the second antenna 405 may transmit/receive in a commercially available frequency band as being partially located adjacent to the first radiating conductor 431, and each of the first and second antennas 403 and 405 may independently transmit/receive a wireless signal.

Figure 12:
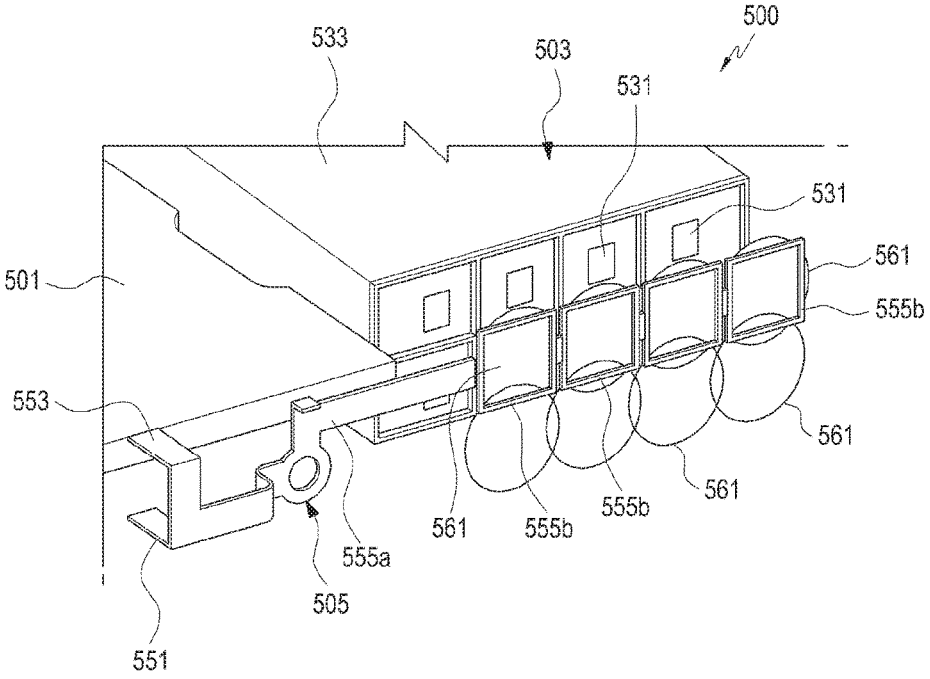
FIG. 12 illustrates another exemplary antenna device of the electronic device according to various embodiments of the present disclosure.
Figure 13:
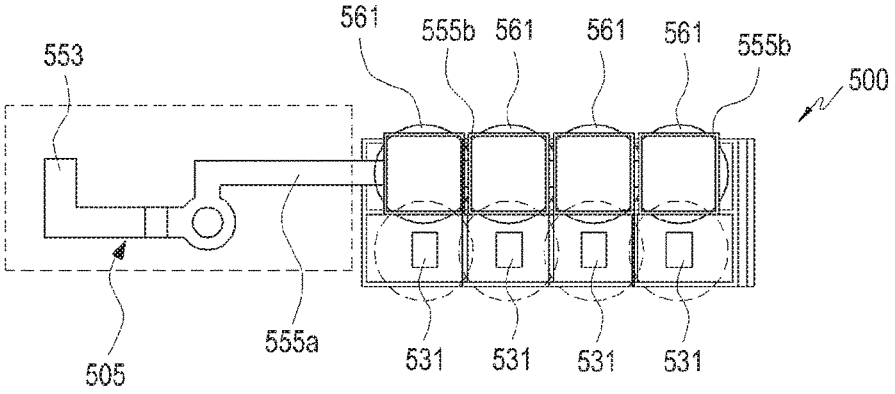
FIG. 13 illustrates another exemplary antenna device of the electronic device according to various embodiments of the present disclosure.

FIG. 12 illustrates another exemplary antenna device 500 of the electronic device according to various embodiments of the present disclosure. FIG. 13 is a font view illustrating another exemplary antenna device 500 of the electronic device according to various embodiments of the present disclosure.

Referring to FIGS. 12 and 13, the antenna device 500 of the electronic device according to various embodiments of the present disclosure may include a first antenna 503 and a second antenna 505, and may further include a lens unit that refracts or reflect a wireless signal transmitted/received through the first antenna 503. The lens unit may include a dielectric portion (e.g., the lens indicated by reference numeral "561") and a conductor portion (e.g., the lens indicated by reference numeral "555*b*"), in which the conductor portion of the lens unit may be connected to the second radiating conductor 555*a* so as to transmit/receive a wireless together with the second radiating conductor 555*a*.

The first antenna 503 (e.g., the first antenna 103 of FIG. 1 and/or FIG. 2) may include a circuit board 533, and a plurality of first radiating conductors 531 arranged on one face (e.g., a side face) of the circuit board 533. For example, the first antenna 503 is an array antenna that is formed by an array of first radiating conductors 531, and may transmit/receive a wireless signal in a first frequency band (e.g., the above-mentioned mmWave frequency band). The circuit board 533 may be a circuit board that is manufactured separately from the main circuit board of the electronic device 501 (e.g., the main circuit board 111 of FIG. 1), and may be disposed in parallel with the main circuit board 501 at a side of the main circuit board 501.

The lens unit may be formed of a combination of dielectric lens(es) 561 and conductor lens(es) 555*b*. In one embodiment, the plurality of dielectric lenses 561 may be disposed to face the first radiating conductors 531, respectively, and may refract (or reflect) a wireless signal transmitted/received through the first radiating conductors 531. The lens unit may include a plurality of conductor lenses 555*b*, and each of the conductor lenses 555*b* may be combined with one of the dielectric lenses 561 so as to refract (reflect) a wireless signal transmitted/received through at least one of the first radiating conductors 531.

The second antenna 505 may include a second radiating conductor 555*a*, and the second radiating conductor 555*a* may include a feeding terminal 553 and a ground terminal 551 that are connected to the main circuit board 501. For example, the second radiating conductor 555*a* may be connected to the main circuit board 501 to be fed with a power and to be grounded so as to transmit/receive a wireless signal in a second frequency band (e.g., the above-mentioned commercially available band(s)) that is(are) lower than the frequency band). In one embodiment, the conductor lens(es) 555*b* is(are) connected to the second radiating conductor 555*a* so as to adjust a resonance frequency that is formed by the second radiating conductor 555*a*. In one embodiment, the conductor lens(es) 555*b* is(are) a parasitic conductor in which at least a portion of a signal power provided to the second radiating conductor 555*a*), and may form a resonance frequency in the second frequency band together with the second radiating conductor 555*a*.

An arrangement structure of the dielectric lenses 561 and/or the conductor lenses 555*b* illustrated in FIG. 12 and/or FIG. 13 corresponds to one of various embodiments that may implement an antenna device and/or an electronic device according to various embodiments of the present disclosure, but the illustrated structure does not limit the present disclosure. For example, although FIG. 12 and/or FIG. 13 exemplify a structure in which eight (8) dielectric lenses 561 and four (4) conductor lenses 555*b* (e.g., the above-mentioned parasitic conductor), the number of the dielectric lenses 561 and the number of the conductor lenses 555*b* may vary according to a specification required for an electronic device, and only some of the plurality of conductor lenses 555*b* are connected to the second radiating conductor 555*a* so as to form a portion of the second antenna 505.

Figure 14:
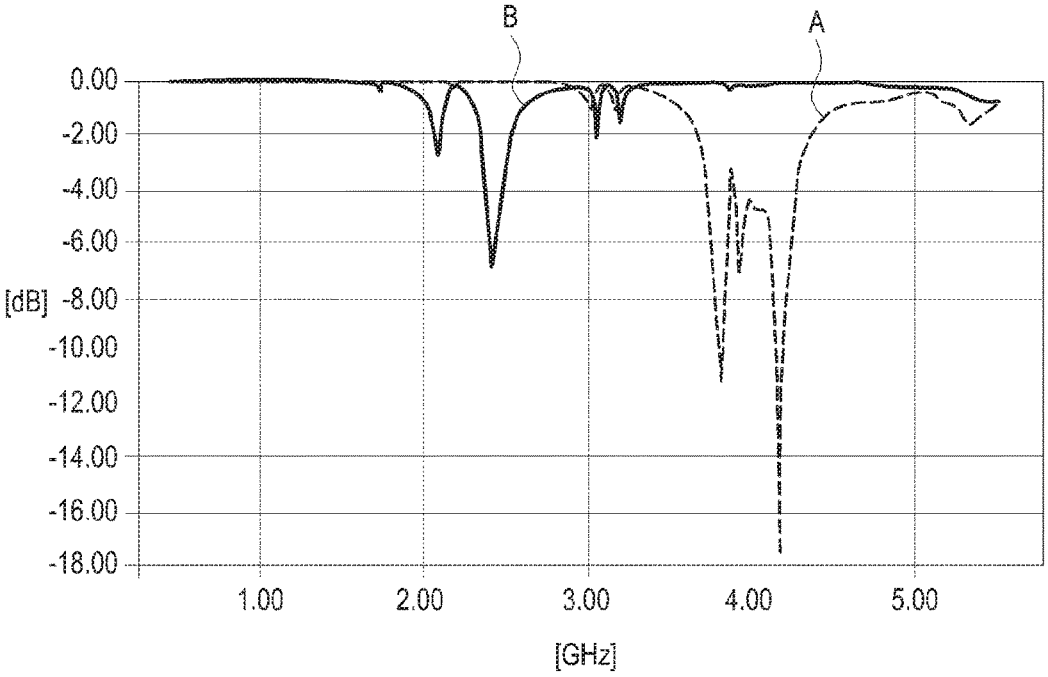
FIG. 14 illustrates a radiating characteristic of the antenna device according to various embodiments of the present disclosure.

FIG. 14 illustrates a radiating characteristic of the antenna device 500 illustrated in FIG. 12 and/or FIG. 13.

In FIG. 14, the graph indicated by "A" represents a reflection coefficient when a wireless signal is transmitted/received only by the second radiating conductor 555*a*, and the graph indicated by "B" represents a reflection coefficient when a wireless signal is transmitted/received by connecting at least some of the conductor lenses 555*b* to the second radiating conductor 555*a*. As illustrated in FIG. 14, the conductor lenses 555*b* may adjust the resonance frequency of the second antenna 505 when the conductor lenses 555*b* are utilized as a parasitic conductor connected to the second radiating conductor 555*a*. For example, it has been found that, before the parasitic conductor is connected to the second radiating conductor 555*a*, the second antenna 505 may form a resonance frequency in a frequency band before or after about 4 GHz, and after the parasitic conductor is connected, the second antenna 505 may form a resonance frequency in a frequency band before or after 2.4 GHz (e.g., the above-mentioned commercially available frequency band) and may secure a radiating efficiency of about 40%.

In one embodiment, the design specification of the first antenna 503 was prepared to have a gain of 14.4 dBi, and the gain of the first antenna 505 was measured as 13.66 dBi when the dielectric lens 561 and/or the conductor lenses 555*b* were disposed in the electronic device and/or the housing of the electronic device. For example, even in the state of being installed in an electronic device, the first antenna 503 is capable of securing an operation performance close to the design specification by disposing the dielectric lens 561 and/or the conductor lenses 555*b* to refract (or reflect) a wireless signal transmitted/received through the first radiating conductors 531.

Figure 15:
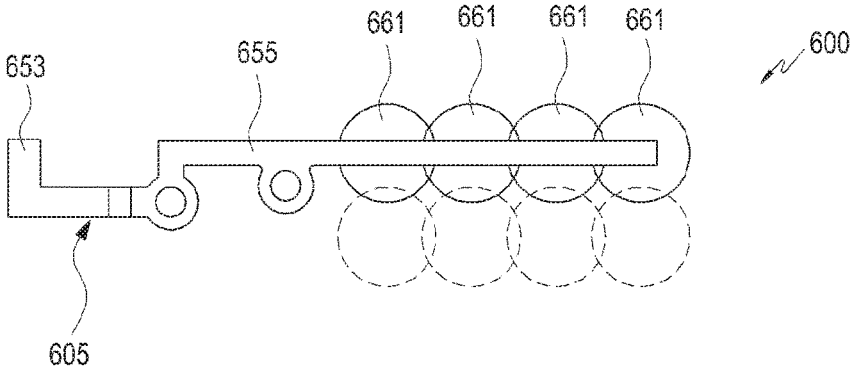
FIG. 15 illustrates another exemplary antenna device of the electronic device according to various embodiments of the present disclosure.

FIG. 15 illustrates one exemplary antenna device 600 of the electronic device according to various embodiments of the present disclosure.

The antenna device 600 illustrated in FIG. 15 is a modification of the antenna device 500 illustrated in FIG. 12. In describing the present embodiment, some of the descriptions related to the components that may be easily understood through the descriptions of the embodiment illustrated in FIG. 12 may be omitted.

Referring to FIG. 15, a portion of a second radiating conductor 655 of a second antenna 605 may be positioned to face at least a portion of the first radiating conductors (e.g., the first radiating conductors 531 of FIG. 12), and may receive a feeding signal from a main circuit board (e.g., the main circuit board 501 of FIG. 12) through a feeding terminal 653 provided at one end thereof. In one embodiment, a portion of the second radiating conductor 655 may form a lens (e.g., the conductor lens 555*b* of FIG. 12) that refracts (reflects) a wireless signal transmitted/received through the first radiating conductors. In one embodiment, a portion of the second radiating conductor 655 may be combined with a dielectric lens(s) 661 to form a lens that refracts (reflects) a wireless signal transmitted/received through the first radiating conductors.

Figure 16:
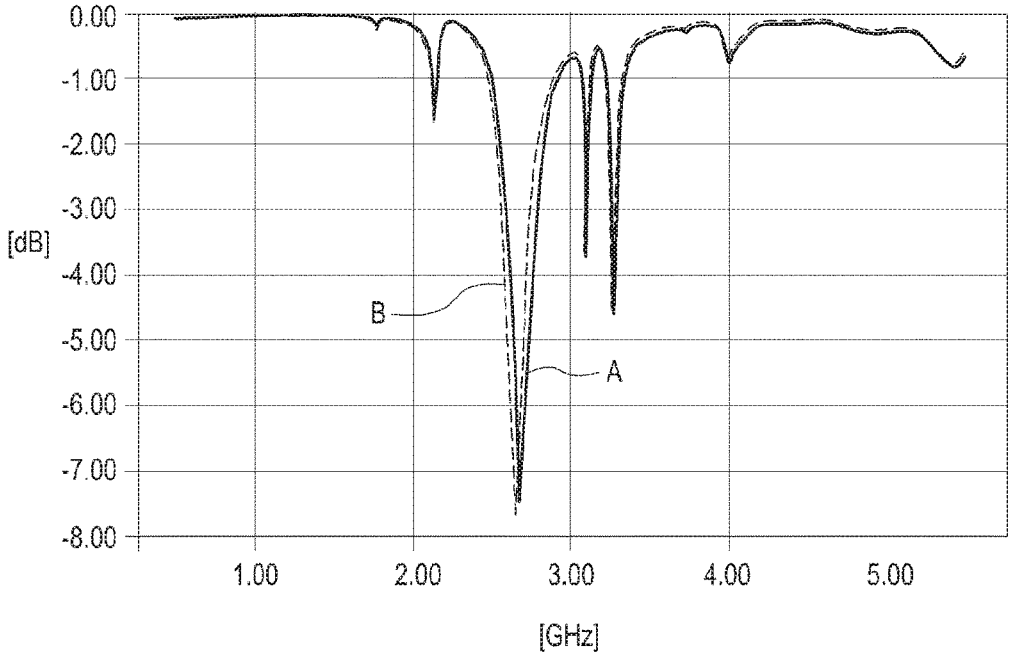
FIG. 16 illustrates a radiating characteristic of the antenna device according to various embodiments of the present disclosure.

FIG. 16 illustrates a radiating characteristic of the antenna device 600 illustrated in FIG. 15.

FIG. 16 illustrates a graph representing results obtained by measuring the reflection coefficients of the second antenna 605 before and after disposing a dielectric lens(es) 661 corresponding to a portion of the second radiating conductor 655. For example, the graph indicated by "A" represents the result obtained by measuring the reflection coefficient of the second antenna, which was measured before the dielectric lens(es) 661 was(were) disposed, and the graph indicated by "B" represents the result obtained by measuring the reflection coefficient of the second antenna 605, which was measured in the state where the dielectric lens(es) 661 was(were) disposed. Upon comparing the results before and after the dielectric lenses 661, it was confirmed that a resonance frequency is changed by about 50 MHz, and the gain of the second antenna 605 is improved by 36% to 39%. For example, the electric lens(es) 661 may adjust the resonance frequency of the second antenna 605, or may improve the gain of the second antenna 605.

Figure 17:
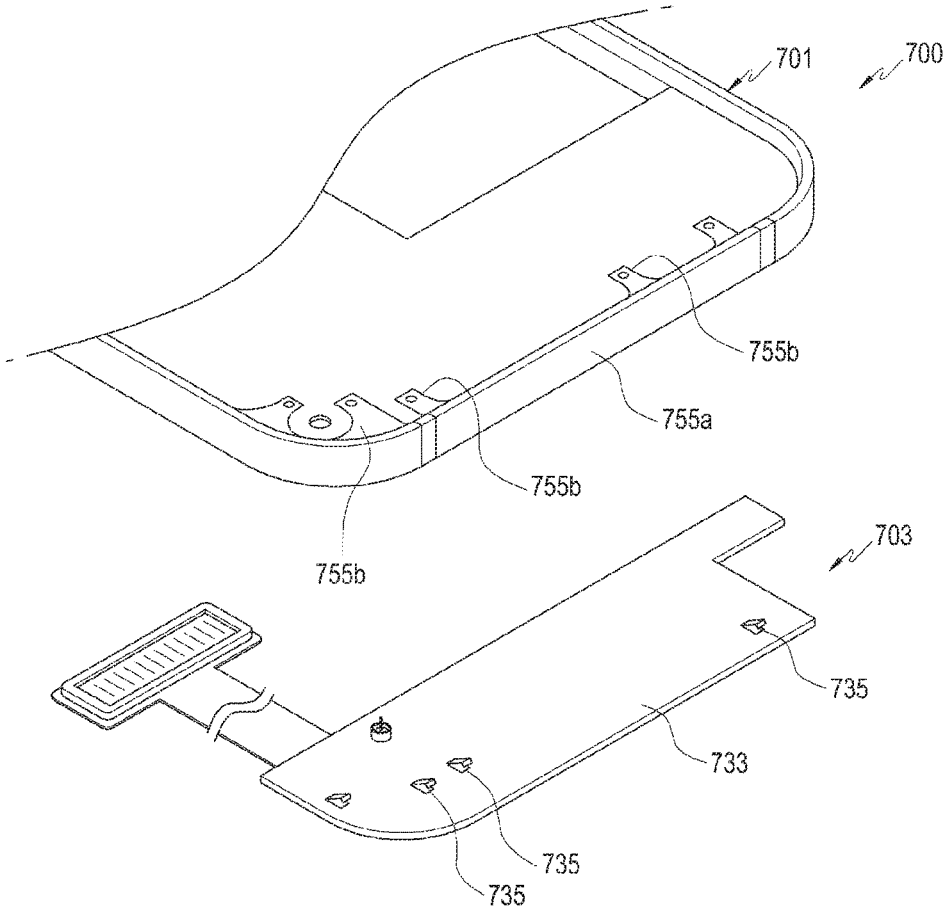
FIG. 17 illustrates another exemplary antenna device of the electronic device according to various embodiments of the present disclosure.

FIG. 17 illustrates one exemplary antenna device 700 of the electronic device according to various embodiments of the present disclosure.

Referring to FIG. 17, an antenna device 700 of the electronic device according to various embodiments of the present disclosure may include a radiating conductor 755*a* formed by a portion of a housing 701 (e.g., the housing 101 illustrated in FIG. 1 and/or FIG. 2).

The housing 701 accommodates a first antenna 703, and at least a portion of the housing 701 may be made of an electric conductor. For example, a side wall of the housing 701 may be made of a conductive metal, and at least a portion of the conductor part of the housing 701 may form the radiating conductor 755*a* (e.g., the second conductor 655 of FIG. 15).

The first antenna 703 may include a circuit board 733 and a first radiating conductor (e.g., the first radiator(s) 141 of FIG. 2) disposed inside the circuit board. The first radiating conductor disposed inside the circuit board 703 may be formed of a combination of a via hole, a conductor filled in the via hole, a printed circuit pattern, and so on. According to various embodiments, at least one connection terminal (e.g., a C-clip) may be disposed on one face of the circuit board 733, and a portion of the radiating conductor 755*a* may be connected to the connection terminal(s) 735 to be fed with a power or to be grounded.

In one embodiment, the side wall of the housing 701 may be made of an electric conductor, and the radiating conductor 755*a* may be formed by a portion of the side wall of the housing 701. The radiating conductor 755*a* may be insulated from other electric conductor portions of the housing 701, and may include at least one connection terminal 755*b* formed therein. The connection terminal 755*b* may be positioned to face the circuit board 733, and may be in contact with the connection terminal 735 so as to electrically connect the radiating conductor 755*a* to the circuit board 733. The radiating conductor 755*a* may be utilized as a lens (and/or a lens unit) that refracts or reflects a wireless signal, as in the above-described various embodiments. For example, the wireless signal transmitted/received through the first radiating conductor(s) formed inside the circuit board 733 may be refracted or reflected by the radiating conductor 755*a*.

Figure 18:
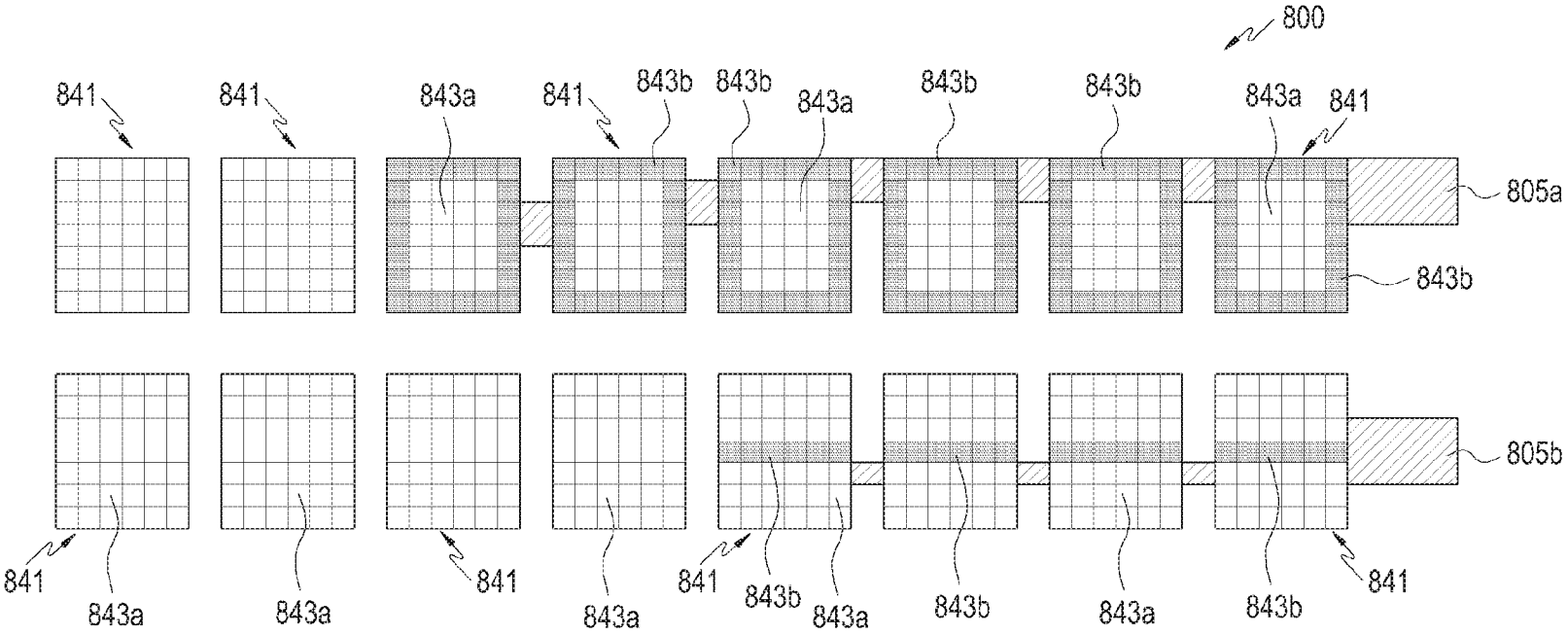
FIG. 18 illustrates yet another exemplary antenna device of the electronic device according to various embodiments of the present disclosure.
Figure 19:
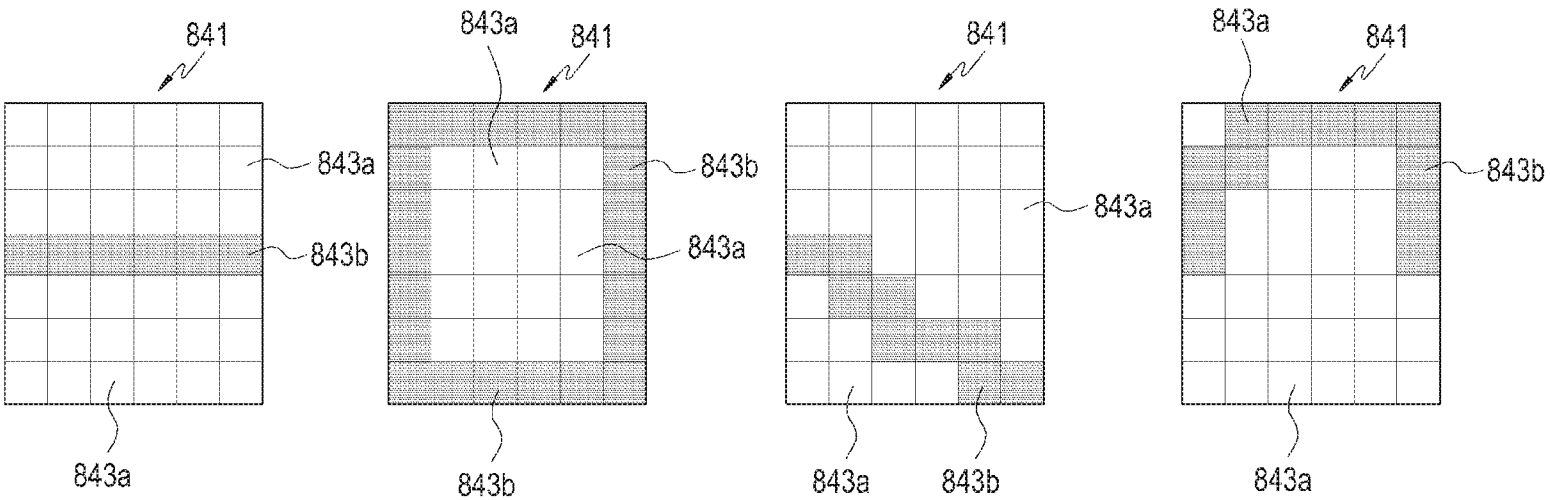
FIG. 19 illustrates various exemplary lenses of the antenna device according to various embodiments of the present disclosure.

FIG. 18 illustrates one exemplary antenna device 800 of the electronic device according to various embodiments of the present disclosure. FIG. 19 is a view illustrating various exemplary lenses 841 of the antenna device illustrated in FIG. 18.

Referring to FIGS. 18 and 19, an antenna device 800 according to the present embodiment may include one or more second radiating conductors 805*a* and 805*b*, and may also include a plurality of lenses 841. In FIGS. 18 and 19, the first antenna and/or the first radiating conductor for mmWave communication are not illustrated for the simplification of illustration. Similarly to the above-described embodiments, the lenses 841 may refract or reflect a wireless signal transmitted/received through the first antenna and/or the first radiating conductor disposed separately from the second radiating conductors 805*a* and 805*b*.

The second radiating conductor(s) 805*a* and 805*b* may transmit/receive a wireless signal, for example, in a commercially available frequency band. In one embodiment, at least a portion of the second radiating conductors 805*a* and 805*b* may refract or reflect, together with the lenses 841, a wireless signal transmitted/received through the first antenna and/or the first radiating conductor.

Each of the lenses 841 may be formed by a combination of a plurality of unit cells 843*a* and 843*b*. Some of the unit cells 843*a* and 843*b* may be formed of a dielectric material, and the others may be formed of an electrically conductive material. As illustrated in FIG. 19, in one embodiment, the unit cells 843*a* of the dielectric material and the unit cells

843*b* of the electrically conductive material may be regularly arranged. For example, the unit cells 843*b* of the electrically conductive material may be arranged along a pattern that crosses the central portion of the lens 841 in the horizontal direction (or in the vertical direction), or an edge portion of the lens 841. In another embodiment, the unit cells 843*a* of the dielectric material and the unit cells 843*b* of the electrically conductive material may be irregularly arranged. For example, the arrangement of the unit cells 843*a* of the dielectric material and the unit cells 843*b* of the electrically conductive material may be set in consideration of a refracting or reflecting direction of a wireless signal transmitted/received through the first radiating conductor.

According to various embodiments, the unit cells 843*b* of the electrically conductive material may be connected to the second radiating conductor(s) 805*a* and 805*b* to be utilized as a parasitic conductor. For example, at least some of the unit cells 843*b* of the electrically conductive material may transmit/receive a wireless signal in a commercially available frequency band together with the second radiating conductors 805*a* and 805*b*. In the case where the unit cells 843*b* of the electrically conductive material are connected to the second radiating conductors 805*a* and 805*b*, the frequency band of a wireless signal transmitted/received through the second radiating conductors 805*a* and 805*b* or the like may be adjusted.

FIGS. 20 to 27 illustrate implemented exemplary antenna devices 900 according to various embodiments of the present disclosure, respectively.

Various embodiments illustrated in FIGS. 20 to 27 are provided in order to help the understanding of arrangements and connection structures of constituent elements such as the above-described first radiating conductors (e.g., the first radiating conductor 531 of FIG. 12), the second radiating conductors (e.g., the second radiating conductor 555*a* of FIG. 12), the circuit boards (e.g., the main circuit board and/or the circuit boards 501 and 533 in FIG. 12), and the shape, the connection structure, or the like of each constituent element may be variously modified according to the structure of a practical electronic device or the like.

Figure 20:
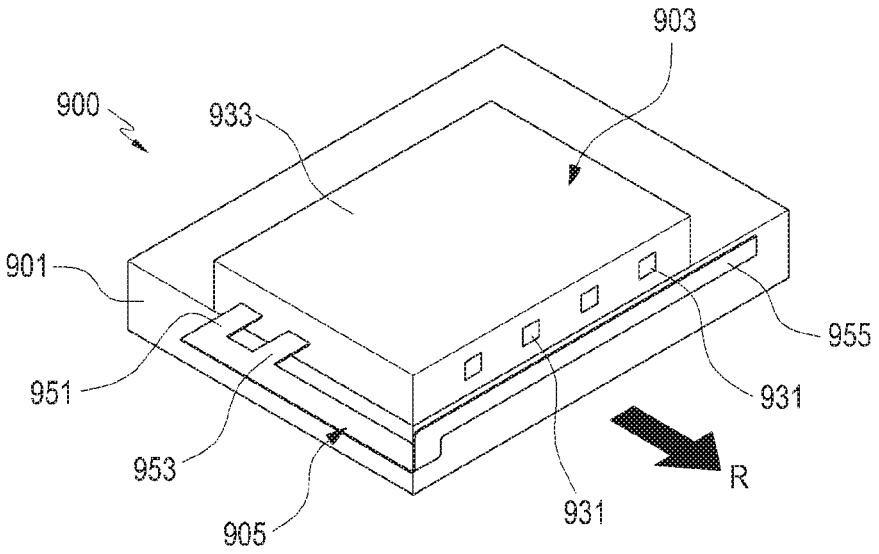
FIGS. 20 to 27 illustrate implemented exemplary antenna devices according to various embodiments of the present disclosure, respectively.

Referring to FIG. 20, the antenna device 900 may include a first modular antenna 903 mounted on a main circuit board 901, and a second antenna 905 that is fed with a power or grounded through a circuit board 933 of the first antenna 903. For example, the first and second antennas 903 and 905 may be commonly fed with a power or grounded. Although the power is fed through the circuit board 933 of the first antenna 903, the band of a resonance frequency formed by the second antenna 905 may be lower than the band of a resonance frequency formed by the first antenna 903. The second radiating conductor of the second antenna 905 is capable of refracting a wireless signal transmitted/received through the first antenna 903. The second radiating conductor 955 may be formed by a portion of the housing of the electronic device, or by processing a separate electric conductor.

Figure 21:
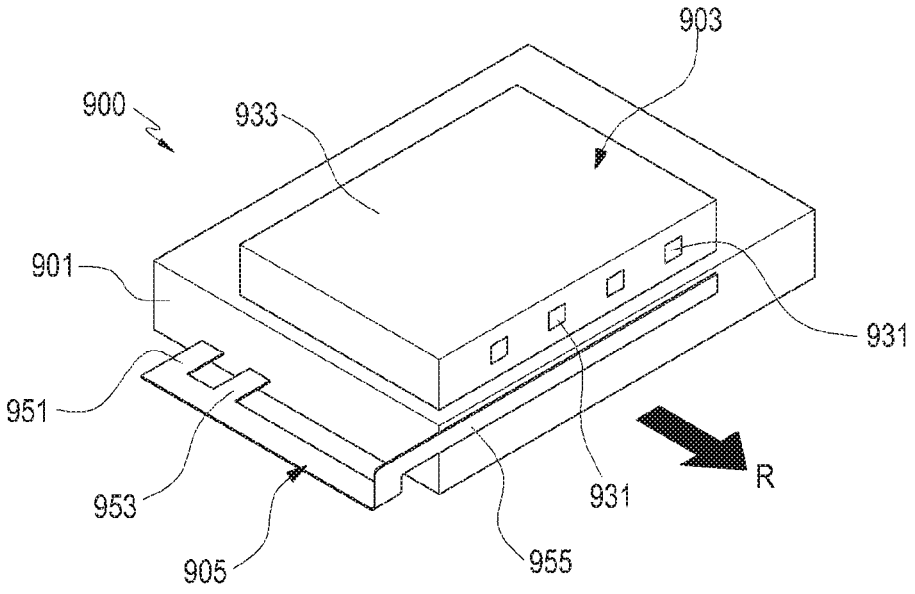

Referring to FIG. 21, the antenna device 900 may include a first modular antenna 903 mounted on a main circuit board 901, and a second antenna 905 that is fed with a power or grounded through the main circuit board 901. For example, the first and second antennas 903 and 905 may be fed with a power or grounded independently from each other. The second radiating conductor 955 of the second antenna 905 is capable of refracting a wireless signal transmitted/received through the first antenna 903. The second radiating conductor 955 may be formed by a portion of the housing of the electronic device, or by processing a separate electric conductor.

Figure 22:
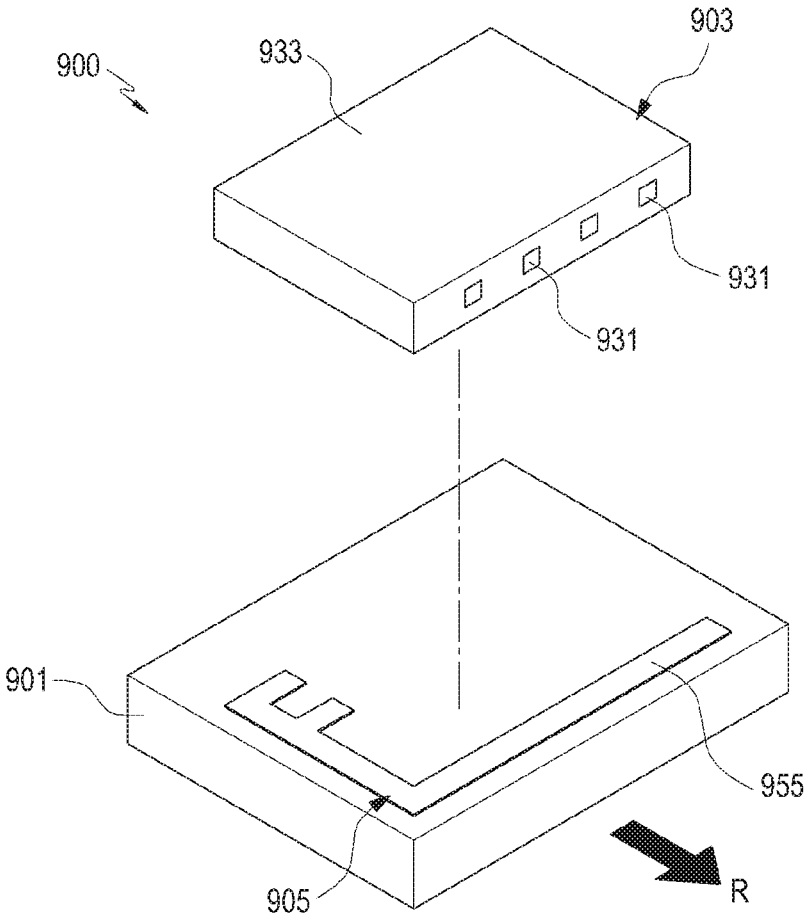

Referring to FIG. 22, the antenna device 900 may include a first modular antenna 903 mounted on a main circuit board 901, and a second antenna 905 in the form of a printed circuit pattern formed on the main circuit board 901. According to various embodiments, the first and second antennas 903 and 905 may be commonly fed with a power or grounded, or may be fed with a power or grounded independently from each other. The second radiating conductor 955 of the second antenna 905 is capable of refracting a wireless signal transmitted/received through the first radiating conductor 931 of the first antenna 903.

Figure 23:
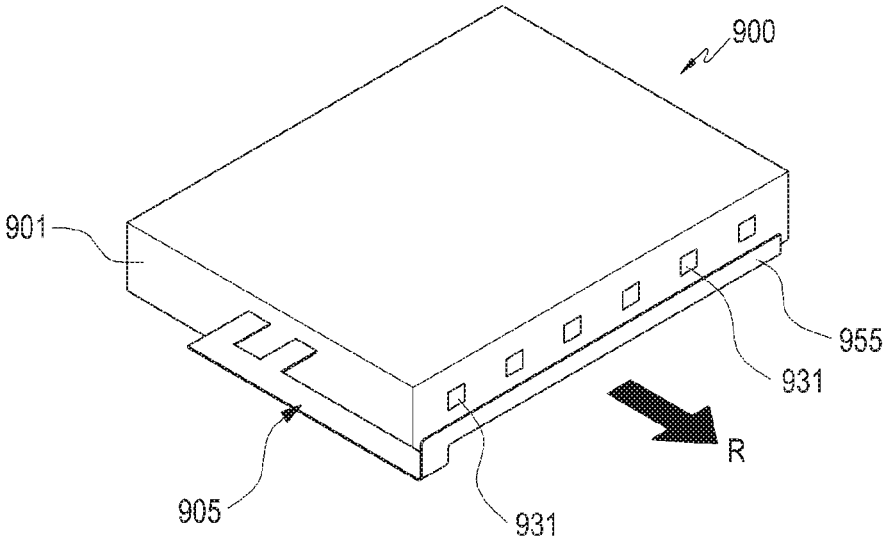

Referring to FIG. 23, the antenna device 900 may include an array antenna formed of an arrangement of first radiating conductors 931 formed on a main circuit board 901, and a second antenna 905 that is fed with a power or grounded through the main circuit board 901. For example, the array antenna and the second antenna 905 may be commonly fed with a power or grounded through the main circuit board 901. The second radiating conductor 955 of the second antenna 905 is capable of refracting a wireless signal transmitted/received through the first radiating conductor 931 of the array antenna. The second radiating conductor 955 may be formed by a portion of the housing of the electronic device, or by processing a separate electric conductor.

Figure 24:
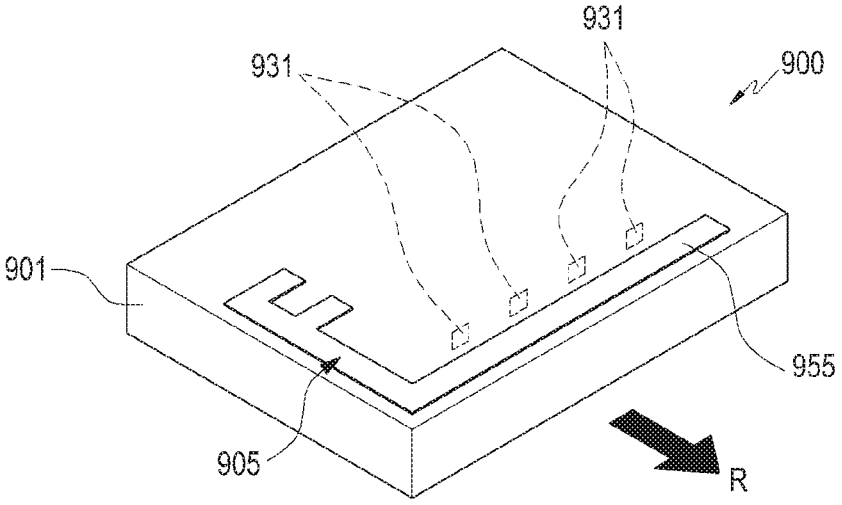

Referring to FIG. 24, the antenna device 900 may include an array antenna formed of an arrangement of first radiating conductors 931 formed in a main circuit board 901 (e.g., inside the main circuit board 901), and a second radiating conductor 905 that is formed on one face of the main circuit board 901 in the form of a printed circuit pattern. For example, the array antenna and the second antenna 905 may be commonly fed with a power or grounded through the main circuit board 901. The second radiating conductor 955 of the second antenna 905 is capable of refracting a wireless signal transmitted/received through the first radiating conductor 931 of the array antenna.

As described above, the first radiating conductor(s) 931 may be formed on the side face of the main circuit board 931 or inside the main circuit board 901, and, in the radiating direction of the first radiating conductors 931, the radiating conductor 955 may be positioned ahead of the first radiating conductors 931. For example, the second radiating conductor 955 is capable of refracting a wireless signal transmitted/received through the first radiating conductors 931.

Figure 25:
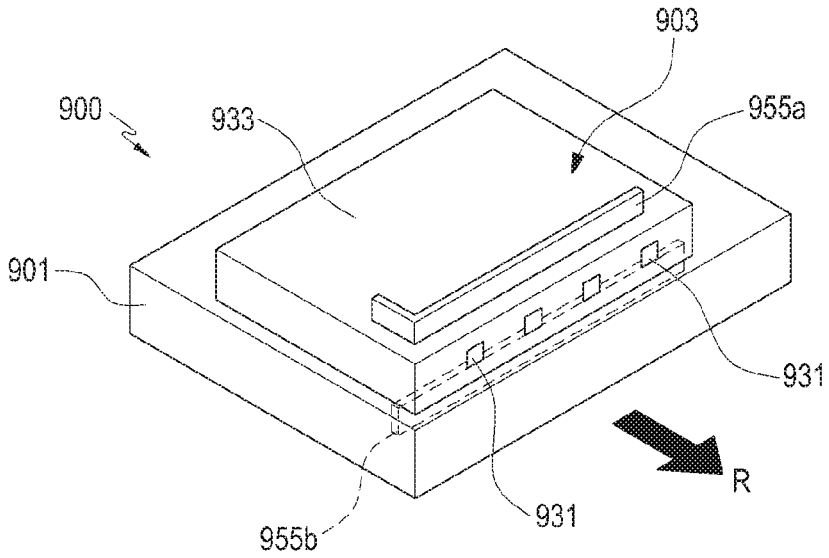

Referring to FIG. 25, the antenna device 900 may include a first modular antenna 903, and a second antenna that is formed of second radiating conductors 955*a* and 955*b* that are respectively arranged on the main circuit board 901 and/or the circuit board 933 of the first antenna 903. For example, one of the second radiating conductors (e.g., a second radiating conductor indicated by reference numeral "955*a*") may be manufactured by processing an electrical conductor, and may be mounted on one face of the circuit board 933. In another embodiment, another one of the second radiating conductors (the second radiating conductor indicated by reference numeral "955*b*") may be formed inside the main circuit board 901, or may be in the form of a printed circuit pattern formed on the main circuit board 901. In still another embodiment, the second antenna may be constituted by a combination of a radiating conductor (e.g., a second radiating conductor indicated by reference numeral "955*a*") mounted on one face of the circuit board 933, and a radiating conductor (e.g., a second radiating conductor indicated by reference numeral "955*b*") formed inside the main circuit board.

Figure 26:
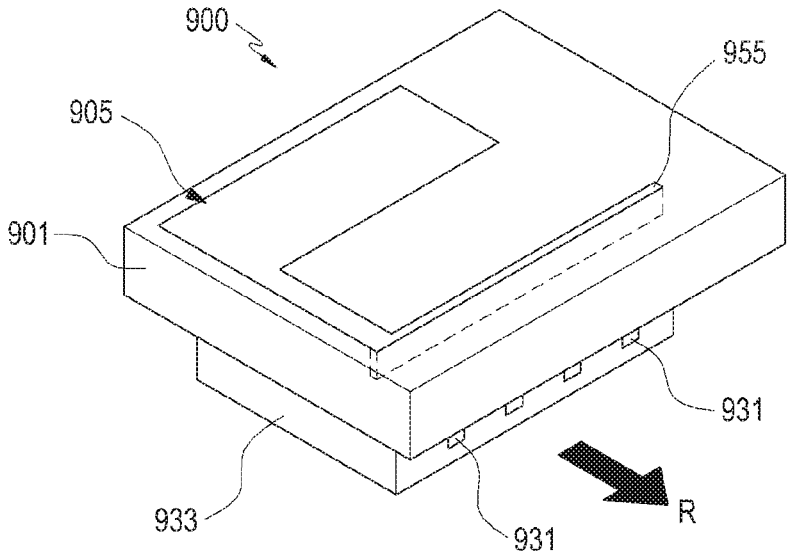

Referring to FIG. 26, the first antenna 903 of the antenna device 900 may be manufactured in a modular form and mounted on the main circuit board 901, and a portion of the second antenna 905 may be in the form of a printed circuit pattern formed on one face of the main circuit board 901. The second radiating conductor 955 of the second antenna 905 may be exposed to one face of the main circuit board 901 while being formed inside the main circuit board 901.

Figure 27:
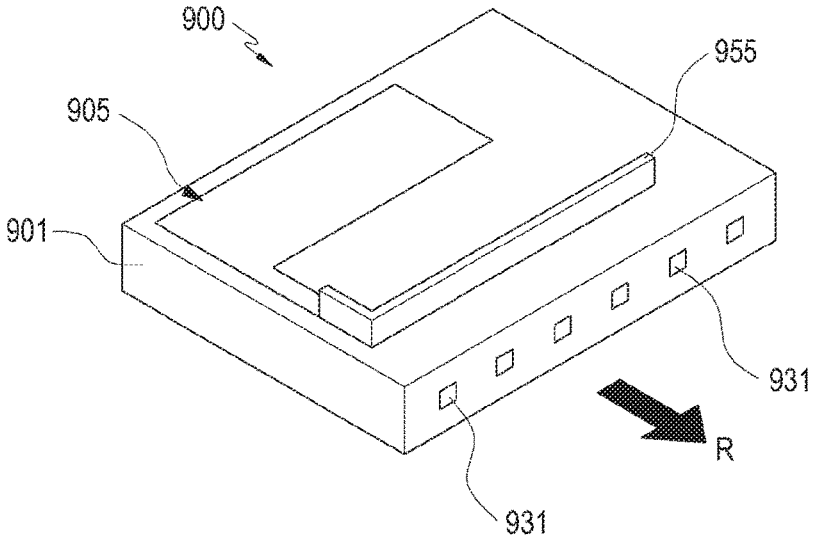

Referring to FIG. 27, the antenna device 900 may include first radiating conductors 931 arranged on one side face of a main circuit board 901, and a second antenna 905 disposed on a face (e.g., the top face) of the main circuit board 901. An array antenna used in mmWave communication may be formed by an arrangement of the first radiating conductors 931, a portion of the second antenna 905 may be in the form of a printed circuit pattern formed on one face of the main circuit board 901, and the second radiating conductor 955 may have a structure mounted on one face of the main circuit board 901.

According to various embodiments, the first antenna 903 and/or first radiating conductors 931 of the array antenna may be positioned ahead of the second radiating conductor (s) 955 in the radiating direction R of a wireless signal. For example, a wireless signal transmitted/received through the first radiating conductors 931 is capable of being reflected by the second radiating conductor(s) 955.

As described above, according to various embodiments of the present disclosure, the electronic device may include: an array antenna including a plurality of first radiating conductors that transmit/receive a wireless signal in a first frequency band and are arranged on a circuit board; and a lens unit including at least one lens disposed on a housing of the electronic device to correspond to the first radiating conductors. The lens unit may refract or reflect a wireless signal transmitted/received through each of the first radiating conductors.

According to various embodiments, the lens may include a dielectric lens formed on an inner face of the housing.

According to various embodiments, a plurality of lenses may be arranged to correspond to the first radiating conductors, respectively, and each of the plurality of lenses may be formed of a combination of unit cells formed on the inner face of the housing.

According to various embodiments, at least some of the unit cells may be formed of dielectric materials that have different sizes or dielectric constants, respectively.

According to various embodiments, some of the unit cells may be formed of a dielectric material, and other unit cells are formed of an electric conductor.

According to various embodiments, the unit cells formed of the dielectric material and the unit cells formed of the electric conductor may be arranged regularly or irregularly to form a plurality of lenses, respectively.

According to various embodiments, the electronic device may further include at least one second radiating conductor disposed on the housing.

Among the unit cells, at least some of the unit cells formed of the electric conductor may be electrically connected to the second radiating conductor, and may transmit/receive, together with the second radiating conductor, a wireless signal in a second frequency band that is lower than the first frequency band.

According to various embodiments, at least a portion of the housing may be made of an electric conductor, and at least a portion of the electric conductor of the housing may form the second radiating conductor.

According to various embodiments, at least a portion of the second radiating conductor may be disposed on a side wall of the housing.

According to various embodiments, the electronic device may further include a main circuit board accommodated in the housing, and the circuit board may be disposed adjacent to the main circuit board.

According to various embodiments, the electronic device may further include at least one second radiating conductor disposed on the housing, and transmitting/receiving a wireless signal in a second frequency band that is lower than the first frequency band. The second radiating conductor may be connected to any one of the circuit board and the main circuit board to receive a feeding signal.

According to various embodiments, the electronic device may further include a second radiating conductor disposed on the housing, and receiving/receiving a wireless signal in a second frequency band that is lower than the first frequency band. A portion of the second radiating conductor may be disposed to correspond to the first radiating conductors, thereby forming the lens unit.

According to various embodiments, the electronic device may further include at least one second radiating conductor disposed on the housing, and a parasitic conductor disposed to correspond to the first radiating conductors. The parasitic conductor and the second radiating conductor may be electrically connected to each other, and may transmit/receive a wireless signal in a second frequency band that is lower than the first frequency band.

According to various embodiments, the parasitic conductor may form the lens unit.

According to various embodiments, the electronic device may further include dielectric members disposed between the parasitic conductor and each of the first radiating conductors. The parasitic conductor and the dielectric members may be combined to form the lens unit.

According to various embodiments of the present disclosure, the electronic device may include: a first antenna including a plurality of first radiating conductors that transmit/receive a wireless signal in a first frequency band and are arranged on a circuit board; and at least one second antenna that transmits/receives a wireless signal in a second frequency band that is lower than the first frequency band, and is arranged adjacent to the first radiating conductors.

A portion of the second antenna may refract or reflect the wireless signal transmitted/received through each of the first radiating conductors.

According to various embodiments, the electronic device may further include a lens unit including at least one lens disposed to correspond to the second radiating conductors. The lens unit may refract or reflect, together with a portion of the second antenna, the wireless signal transmitted/received through each of the first radiating conductors.

According to various embodiments, each of the plurality of lenses may be formed of a combination of unit cells formed on the inner face of the housing.

According to various embodiments, some of the unit cells may be formed of a dielectric material, and other unit cells may be formed of an electric conductor.

According to various embodiments, among the unit cells, the unit cells formed of the electric conductor may be connected to the second antenna to transmit/receive a wireless signal.

In the foregoing detailed description, specific embodiments of the present disclosure have been described. However, it will be evident to a person ordinarily skilled in the art that various modifications may be made without departing from the scope of the present disclosure. For example, the second antennas and/or the second radiating conductor of the above-described electronic device may be provided plurally, and are capable of transmitting/receiving a wireless signal in various frequency bands (e.g., a commercially available frequency band, WiFi, Bluetooth, and Near Field communication (NFC)).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:

an array antenna including a plurality of first radiating conductors configured to transmit or receive a wireless signal in a first frequency band, wherein the plurality of first radiating conductors are arranged on a circuit board;

at least one second radiating conductor disposed on a housing; and a lens unit including at least one lens disposed on the housing of the electronic device corresponds to the first radiating conductors, wherein the at least one second radiating conductor is configured to transmit or receive a wireless signal in a second frequency band that is lower than the first frequency band, wherein a portion of the at least one second radiating conductor is disposed to correspond to the first radiating conductors, and wherein at least one of the lens unit or the portion of the at least one second radiating conductor is configured to refract or reflect the wireless signal transmitted or received through each of the first radiating conductors.

2. The electronic device of claim 1, wherein the at least one lens includes a dielectric lens formed on an inner face of the housing.

3. The electronic device of claim 1, wherein a plurality of lenses are arranged to correspond to the first radiating conductors, respectively, and wherein each of the plurality of lenses is formed of a combination of unit cells that are formed on an inner face of the housing.

4. The electronic device of claim 3, wherein at least one of the unit cells is formed of dielectric materials that have different sizes or dielectric constants, respectively.

5. The electronic device of claim 3, wherein at least one of the unit cells is formed of a dielectric material, and other unit cells are formed of an electric conductor.

6. The electronic device of claim 5, wherein the at least one of the unit cells formed of the dielectric material and the other unit cells formed of the electric conductor are arranged regularly or irregularly to form the plurality of lenses, respectively.

7. The electronic device of claim 5, wherein the at least one of the unit cells formed of the electric conductor is electrically connected to the at least one second radiating conductor that transmits or receives the wireless signal, together with the at least one second radiating conductor in the second frequency band.

8. The electronic device of claim 7, wherein at least a portion of the housing comprises the electric conductor, and wherein at least a portion of the electric conductor of the housing forms the second radiating conductor.

9. The electronic device of claim 8, wherein at least a portion of the second radiating conductor is disposed on a side wall of the housing.

10. The electronic device of claim 1, further comprising a main circuit board accommodated in the housing, wherein the circuit board is disposed adjacent to the main circuit board.

11. The electronic device of claim 10, wherein the second radiating conductor is connected to one of the circuit board and the main circuit board to receive a feeding signal.

12. The electronic device of claim 1, further comprising a parasitic conductor disposed to correspond to the first radiating conductors, wherein the parasitic conductor is electrically connected to the at least one second radiating conductor and is configured to transmit or receive the wireless signal in the second frequency band together with the at least one second radiating conductor.

13. The electronic device of claim 12, wherein the parasitic conductor forms the lens unit.

14. The electronic device of claim 12, further comprising dielectric members disposed between the parasitic conductor and each of the first radiating conductors, wherein the parasitic conductor and the dielectric members are combined to form the lens unit.

15. An electronic device comprising:

a first antenna including a plurality of first radiating conductors configured to transmit or receive a wireless signal in a first frequency band and are arranged on a circuit board; and at least one second antenna is configured to transmit or receive a wireless signal in a second frequency band that is lower than the first frequency band, the at least one second antenna being arranged adjacent to the first radiating conductors, wherein a portion of the at least one second antenna is configured to refract or reflect the wireless signal that is transmitted or received through each of the first radiating conductors.

16. The electronic device of claim 15, further comprising a lens unit including at least one lens disposed to correspond to second radiating conductors, wherein the lens unit is configured to refract or reflect, together with the portion of the at least one second antenna, the wireless signal that is transmitted or received through each of the first radiating conductors.

17. The electronic device of claim 16, wherein each of a plurality of lenses is formed of a combination of unit cells that are formed on an inner face of a housing.

18. The electronic device of claim 17, wherein at least one of the unit cells is formed of a dielectric material, and other unit cells are formed of an electric conductor.

19. The electronic device of claim 18, wherein the at least one of the unit cells formed of the electric conductor is connected to the second antenna to transmit or receive the wireless signal.

* * * * *